US005353471A

United States Patent [19]

Gühne et al.

[11] Patent Number: 5,353,471

[45] Date of Patent: Oct. 11, 1994

[54] APPARATUS FOR PERFORMING WORK ON A FLOOR SURFACE

[75] Inventors: Wieland Gühne, Remscheid; Heinz-Jürgen Ahlf, Bergisch-Gladbach, both of Fed. Rep. of Germany; Gentile Marafante, Carnate; Mario Tecchiati, Villa Raverio, both of Italy

[73] Assignee: Vorwerk & Co. Interholding GmbH, Wuppertal

[21] Appl. No.: 992,526

[22] Filed: Dec. 17, 1992

[30] Foreign Application Priority Data

Dec. 17, 1991 [DE] Fed. Rep. of Germany ..... 9115602

[51] Int. Cl.[5] ..... A47L 9/32

[52] U.S. Cl. ..... 15/339; 15/49.1; 15/410

[58] Field of Search ..... 15/339, 410, 49.1

[56] References Cited

U.S. PATENT DOCUMENTS

| | | | |
|---|---|---|---|
| 2,525,282 | 10/1950 | Brace | 15/410 |
| 2,671,924 | 3/1954 | Segesman | 15/410 X |
| 2,881,465 | 4/1959 | Duff | 15/410 X |
| 3,154,802 | 11/1964 | Hanschitz et al. | 15/410 X |

*Primary Examiner*—Chris K. Moore
*Attorney, Agent, or Firm*—Walter Ottesen

[57] ABSTRACT

The invention relates to an apparatus for performing work on a floor surface such as an electrically driven vacuum and polishing machine. The machine includes a chassis and a wand pivotally connected to the chassis by a pivot connection. A vacuum cleaner suction unit is mounted on the wand and the weight force of the suction unit acts outside of the center of gravity conjointly defined by the chassis and the floor working device mounted on the chassis. The floor working device acts on the floor surface with an uneven force distribution. A spring coacts with the pivot connection to shift at least a portion of the weight force of the suction unit to the center of gravity of both the chassis and the floor working device to provide a more even distribution of the force acting on the floor surface.

5 Claims, 4 Drawing Sheets

APPARATUS FOR PERFORMING WORK ON A FLOOR SURFACE

FIELD OF THE INVENTION

The invention relates to an apparatus for performing work on a floor surface such as an electrically driven vacuum and polishing machine. The machine includes a chassis and a wand pivotally connected to the chassis. A vacuum cleaner suction unit is mounted on the wand and the weight force of the suction unit acts outside of the center of gravity conjointly defined by the chassis and floor working means mounted on the chassis.

BACKGROUND OF THE INVENTION

Spring compensating systems of different kinds are known. Thus, U.S. Pat. No. 4,888,850 shows an arrangement for reducing the pushing force of a vacuum cleaner nozzle on the surface being worked wherein this reduction is achieved with the aid of a spring.

However, a compensating system which distributes the weight force of a decentrally mounted vacuum cleaner suction unit on all brushing or polishing discs of a vacuum and polishing machine was not previously known.

Because such a compensating system was not previously known, the discs became unevenly worn in accordance with the different weight forces acting thereon. This makes a frequent exchange of the discs necessary which are in part greatly worn down because of the uneven distribution of the weight. This makes it necessary for the consumer to frequently order a substitute part which increases cost during the service life of the apparatus. The one-sided weight distribution makes itself manifest in a negative manner in that the machine runs away when working the floor surface. This occurrence can be explained in that the disc which is loaded more than the other discs is pressed on the floor surface so greatly that it operates as a drive and causes the apparatus to move out laterally. In order to operate effectively, the operator must then continuously apply a counterforce against the outward lateral movement which requires additional effort.

SUMMARY OF THE INVENTION

It is an object of the invention to provide an apparatus for performing work on a floor surface wherein the weight force of the apparatus is uniformly distributed so that the above-mentioned disadvantages cannot occur.

The apparatus of the invention is for performing work on a floor surface and includes: a chassis; floor working means for performing work on the floor surface over an area of the floor surface at any given time as the apparatus is moved on the floor surface; the chassis and the floor working means conjointly defining a first center of gravity; a wand assembly extending outwardly from the chassis and defining a second center of gravity producing a weight force which causes the floor working means to act on the floor surface with an uneven force distribution over the area; the wand assembly being elongated and having a first end adapted to be held by an operator and a second end; pivot means for pivotally connecting the second end to the chassis; and, resilient means interposed between the chassis and the pivot means for shifting at least a portion of the weight force to the first center of gravity in dependence upon the angular position at which the wand assembly is held by the operator whereby the force distribution becomes substantially uniform.

The advantage of the apparatus of the invention is seen especially in that there is no wearing of one disc which is more rapid than the wear on the remaining discs. The discs must be exchanged less frequently and the cost of replacement parts is reduced. The apparatus no longer moves out laterally which means that the work of the operator is significantly facilitated.

According to a feature of the invention, a switch automatically switches off the apparatus when the apparatus is placed in storage.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
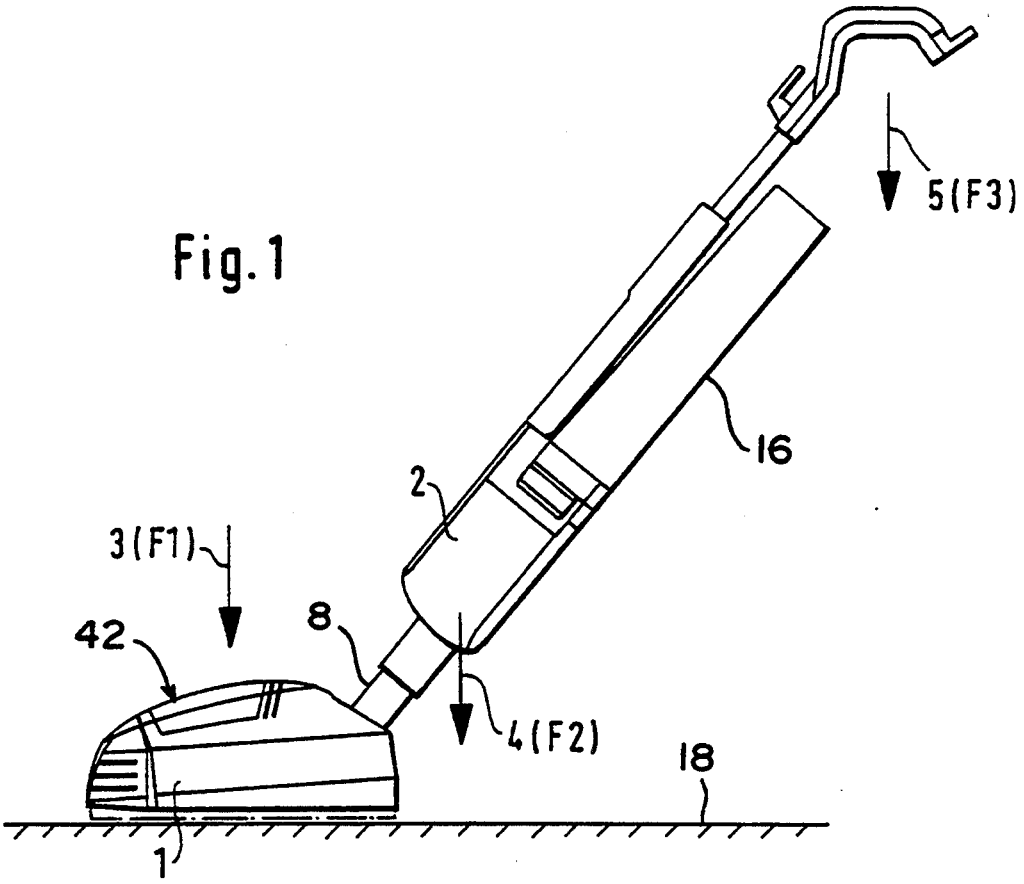
FIG. 1 is a schematic showing a side elevation view of a vacuum and polishing machine having a wand on which a vacuum cleaner unit is mounted.
Figure 2:
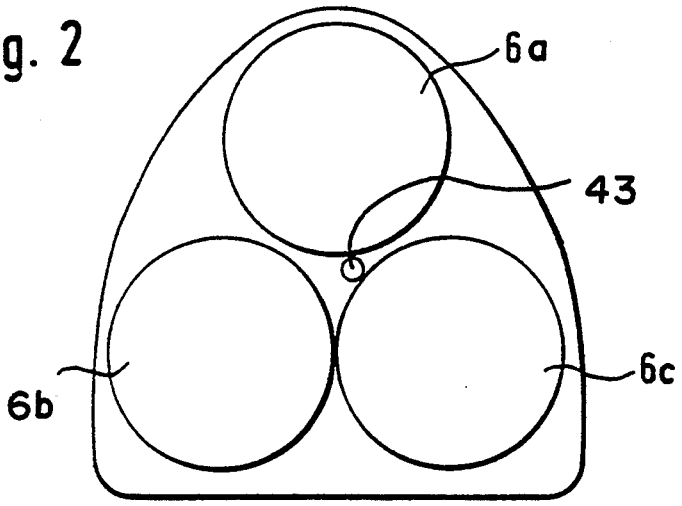
FIG. 2 is a plan view of the bottom of the chassis showing the rotating discs of the vacuum and polishing machine of FIG. 1.

FIG. 1 shows the force distribution in the vacuum and polishing machine 42 of the invention wherein a vacuum cleaner unit 16 is mounted on a wand 8. The weight force 4 (F2) acts at the center of gravity of the vacuum cleaner unit 16 outside of the polishing unit 1 and force 3 (F1) acts at the center of gravity of the polishing unit 1. The force 5 (F3) represents the upward force applied to the wand 8 by the operator when working with the machine. The polishing unit 1 includes three work discs 6*a* to 6*c* shown in FIG. 2. The weight forces 3 and 4 cause the forces with which the three work discs 6*a* to 6*c* act upon the work surface 18 to be different. Reference numeral 43 identifies a drive pinion for driving the discs 6*a* to 6*c*.

Figure 3:
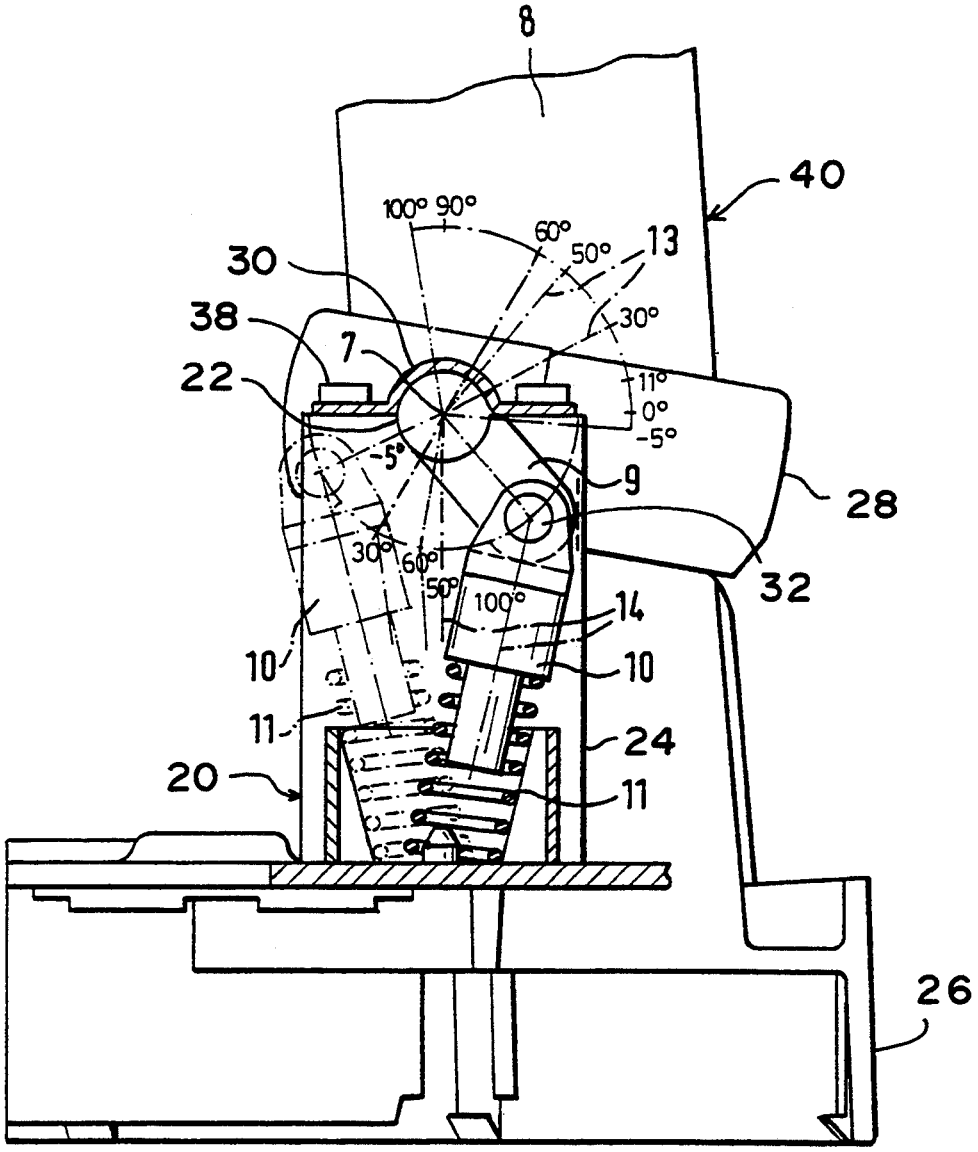
FIG. 3 is a side elevation view of the rearward portion of the chassis showing a compensating device for shifting the weight force of the vacuum cleaner unit to balance the forces with which the work discs act on the work surface.
Figure 4:
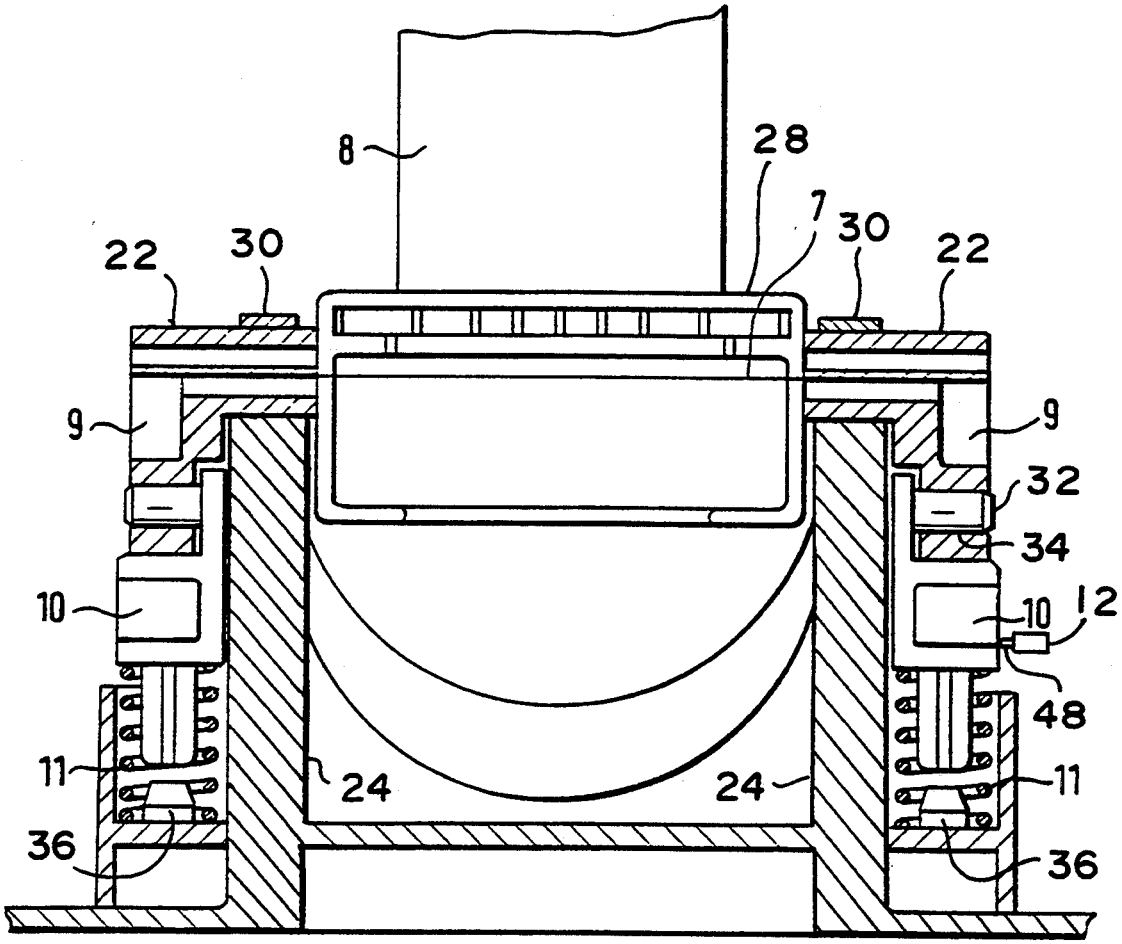
FIG. 4 is a front view of the compensating device shown in FIG. 3.

Two compensating springs 11 are provided in the arrangement shown in FIGS. 3 and 4 for balancing the forces with which the work discs 6*a* to 6*c* act upon the work surface 18. The compensating springs 11 shift the weight force 4 to the force 5 (F3) and to the center of gravity of the polishing unit 16.

The vacuum and polishing machine 42 is provided with a compensating device 20 which includes the springs 11 as well as pivot pins 22 mounted on two vertical mounts 24 extending upwardly from the chassis 26 near the rear end thereof. The compensating device 20 with the springs 11 achieves the above-mentioned shift of the weight force 4. The wand 8 is attached to a base 28 from which the pivot pins 22 laterally extend. The pivot pins 22 define a pivot axis 7 and are pivotally journalled in respective ones of the mounts 24 as shown. Brackets 30 securely hold the pivot pins 22 on respective ones of the mounts 24. The brackets 30 are securely fastened to mounts 24 by screws 38. Each pivot pin 22 has a pivot arm 9 formed thereon. The wand 8, base 28, pivot pins 22 and pivot arms 9 conjointly define a structure which pivots on mounts 24 as a single piece 40. Guide parts 10 are pivotally connected to corresponding ones of the pivot arms 9 via pivot pins 32. The pivot pin 32 is an integral part of the guide part 10 and is pivotally journalled in a bearing opening 34 formed in the pivot arm 9. The pressure springs 11 are interposed between the chassis 26 and corresponding ones of the guide parts 10. Locator guide pins 36 hold the springs 11 in position on the chassis 26. The pressure springs 11 act on corresponding ones of the pivot arms 9 via the guide parts 10.

The compensating device 20 with its springs 11 shifts the weight force 4 (F2) to the force 5 (F3) and to the gravity center of the polishing unit 1 where the weight force 3 (F1) acts.

Figure 5:
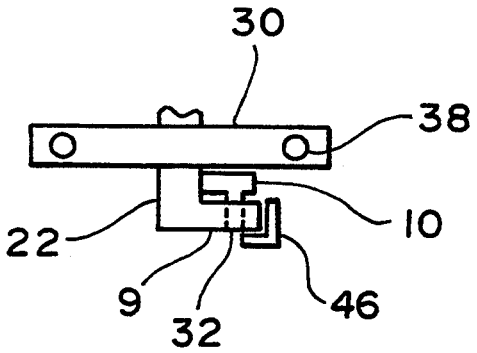
FIG. 5 is a detail view showing how the lever arm of the compensating device coacts with a stop in the form of an angle mounted on the chassis.

The broken lines 13 in FIG. 3 show various angular positions of the piece 40 while the respective extensions 14 of these lines show the corresponding positions of the pivot arms 9. The piece 40 is shown in the storage position of the vacuum and polishing machine 42. A stop prevents the pivot arms 9 from pivoting farther in the counterclockwise direction and defines the position of the wand 8 when the machine 42 is placed in storage. The stop is schematically represented by a line 44 in FIG. 3 and is fixedly mounted on the chassis 26. The stop can be configured as an angle 46 as shown in FIG. 5. The angle 46 extends vertically upward from the chassis 26 and stops the movement of pivot arm 9 in the position shown in solid outline in FIG. 3.

When the vacuum and polishing machine 42 is brought into use by an operator, the pivot arms 9 rotate in the clockwise direction causing the springs 11 to compress and again expand after the arms 9 pass through the bottom dead center position (50°) thereof. The force which each spring imparts to the pivot arms 9 after passing the bottom dead center position (50°) in the clockwise direction becomes less and less until the spring is completely relaxed at −5°. The guide part 10 is shown in phantom outline for the position corresponding to −5° and the wand 8 is substantially horizontal.

The solid line position of the guide part 10 shows the storage position (100°) of the vacuum and polishing machine. The wand 8 is then in the position shown in FIG. 3. The springs 11 apply a reduced force to the pivot arms 9 to hold the wand 8 in the storage position (100°).

The configuration of the pivot arms 9, pressure springs 11 and guide parts 10 must be selected for a particular apparatus in accordance with the other components thereof in order to ensure that the forces applied by the work discs to the work surface 18 are balanced.

When the wand 8 is pivoted in the counterclockwise direction preparatory to placing the vacuum and polishing machine in storage, the pivot arm 9 moves the guide part 10 past a microswitch 12 and actuates the latter in the range of approximately 60° to 80° measured relative to the horizontal. The microswitch 12 then switches the machine off. The microswitch 12 can be mounted at a suitable location on the chassis 26 or mount 24 so as to be actuated by the guide part 10 as shown in FIG. 4. When the guide part 10 is in the 60° to 80° range, the guide part 10 strikes the toggle 48 of the microswitch 12.

It is understood that the foregoing description is that of the preferred embodiments of the invention and that various changes and modifications may be made thereto without departing from the spirit and scope of the invention as defined in the appended claims.

What is claimed is:

1. An apparatus for performing work on a floor surface, the apparatus comprising:

a chassis;

floor working means mounted in said chassis for performing work on the floor surface over an area of said floor surface as said apparatus is moved on said floor surface;

said chassis and said floor working means conjointly defining a first center of gravity;

a wand assembly extending outwardly from said chassis and defining a second center of gravity producing a weight force which causes said floor working means to act on said floor surface with an uneven force distribution over said area;

said wand assembly being elongated and having a first end adapted to be held by an operator and a second end;

pivot means for pivotally connecting said second end to said chassis so as to permit said want to be pivotally moved between a work position wherein the operator holds said second end during the performance of the work on the floor surface and a rest position wherein said wand assembly stands substantially upright on said chassis; and, resilient biasing means for developing a first resilient force when said wand is in said work position to shift at least a portion of said weight force to said first center of gravity whereby said force distribution becomes substantially uniform while said second end is held by the operator during said performance of said work and for developing a second resilient force less than said first resilient force when said wand assembly is in said rest position.

2. The apparatus of claim 1, said pivot means including: a pivot mount on said chassis, and, a pivot shaft fixedly connected to said second end of said wand assembly and pivotally journalled on said pivot mount; said resilient means including a pivot arm fixedly connected to said pivot shaft and a spring guide pivotally connected to said pivot arm and a spring interposed between said pivot arm and said chassis for resiliently biasing said pivot shaft and said wand assembly relative to said chassis.

3. The apparatus of claim 2, wherein said want assembly is pivotable between said rest position and a substantially horizontal position; and, said pivot means and said resilient means being configured so as to cause said spring to be relaxed when said wand assembly is in said substantially horizontal position.

4. The apparatus of claim 3, further comprising stop means for stopping said pivot arm when said wand assembly reaches said rest position; and, said pivot means and said resilient means being further configured so as to cause said spring to apply said second resilient force to said pivot lever which ensures that said wand assembly remains in said rest position during storage of said apparatus.

5. The apparatus of claim 1, said floor working means including an electric motor and said apparatus further comprising switch means switching off said electric motor when said wand assembly is pushed toward said rest position and passes through an angle of 60° to 80° measured relative to the floor surface.

* * * * *

UNITED STATES PATENT AND TRADEMARK OFFICE

CERTIFICATE OF CORRECTION

PATENT NO. : 5,353,471

DATED : October 11, 1994

INVENTOR(S) : Wieland Gühne, Heinz-Jürgen Ahlf, Gentile Marafante and Mario Tecchiati It is certified that error appears in the above-identified patent and that said Letters Patent is hereby corrected as shown below:

In column 4, line 23: delete "want" and substitute -- wand -- therefor.

In column 4, line 48: delete "want" and substitute -- wand -- therefor.

Signed and Sealed this

Thirteenth Day of December, 1994

*Attest:*

*Attesting Officer*

BRUCE LEHMAN

*Commissioner of Patents and Trademarks*